US007463557B2

(12) United States Patent
Galie et al.

(10) Patent No.: US 7,463,557 B2
(45) Date of Patent: Dec. 9, 2008

(54) ELECTRONIC DEVICE WITH CHANGEABLE DISPLAY CONFIGURATIONS

(75) Inventors: Louis M. Galie, Newtown, CT (US); Wolfgang Burkhardt, Ispringen (DE); Gerhard Stotz, Eisingen (DE); Hans G. Schnell, Karlsbad-Langensteinbach (DE); Roland Burghausen, Niefern (DE)

(73) Assignee: Timex Group B.V. (NL)

( * ) Notice: Subject to any disclaimer, the term of this patent is extended or adjusted under 35 U.S.C. 154(b) by 211 days.

(21) Appl. No.: 11/544,084

(22) Filed: Oct. 6, 2006

(65) Prior Publication Data

US 2008/0084794 A1 Apr. 10, 2008

(51) Int. Cl.
*G04B 19/00* (2006.01)

(52) U.S. Cl. ..... 368/223; 368/242

(58) Field of Classification Search ..... 368/76, 368/223, 239, 228, 229, 242, 232–236
See application file for complete search history.

(56) References Cited

U.S. PATENT DOCUMENTS

| | | | | |
|---|---|---|---|---|
| 619,078 | A | 2/1899 | Handly | |
| 1,216,556 | A | 2/1917 | Faiella | |
| 2,506,134 | A | 5/1950 | Burchell | |
| 4,541,727 | A | 9/1985 | Rosenthal | |
| 4,660,992 | A * | 4/1987 | Paul et al. | 368/223 |
| 4,775,964 | A | 10/1988 | Alessio et al. | |
| 4,796,240 | A | 1/1989 | Stevens | |
| 5,008,869 | A | 4/1991 | Dweck | |
| 5,018,118 | A * | 5/1991 | Ross | 368/228 |
| 5,077,709 | A | 12/1991 | Feher | |
| 5,224,078 | A | 6/1993 | Mallin | |
| 5,751,667 | A | 5/1998 | Nunes | |
| 5,787,055 | A | 7/1998 | Alpert | |
| 5,793,710 | A | 8/1998 | Jacobi, Jr. | |
| 6,118,735 | A | 9/2000 | Li | |
| 7,035,171 | B2 * | 4/2006 | Hurni et al. | 368/232 |
| 2005/0185519 | A1 | 8/2005 | Kent | |

* cited by examiner

*Primary Examiner*—Edwin A. Leon
*Assistant Examiner*—Thanh S Phan
(74) *Attorney, Agent, or Firm*—Carmody & Torrance LLP

(57) ABSTRACT

A display assembly for a wearable electronic device. The display assembly is disposed within a housing of the wearable electronic device. The electronic device is constructed to receive at least a first and second dial assembly each of which is adapted to provide a different display configuration. The display assembly comprises a liquid crystal display assembly comprising at least two display sections, driving means for providing driving signals to the respective display sections; and a controller, operatively coupled to the driving means, for signaling the driving means to provide the driving signals; wherein the display configuration of the wearable electronic device is changeable based on the dial assembly operatively coupled within the housing, wherein the first dial assembly provides for the viewability of at least the first display section and the second dial assembly provides for the viewability of at least the second display section. A method of customizing the display of a wearable electronic device is also provided. In a specific embodiment, the wearable electronic device is a wristwatch.

14 Claims, 4 Drawing Sheets

ELECTRONIC DEVICE WITH CHANGEABLE DISPLAY CONFIGURATIONS

BACKGROUND OF THE INVENTION

This invention relates generally to wearable electronic devices, such as wristworn devices, and in particular, to a wearable electronic device such as for example and not limitation, a wristwatch, that provides for changeable display configurations based on the dial assembly provided. Specifically, the present invention is directed to the customization or changeability of the resulting display provided thereby.

Wristworn and/or timekeeping devices having removable and/or changeable displays are known, examples of which are described in U.S. Pat. Nos. 5,224,078; 2,506,134; 619,078; 1,216,556; 4,541,727; 4,660,992; 4,796,240; 5,008,869; 5,018,118; 5,077,709; 5,751,667; 5,787,055; 5,793,710 and 6,118,735.

To date, the present inventors are not aware of any wearable electronic device that comprises a digital display, such as a liquid crystal display, along with a dial assembly that can be changed to thereby change the display configuration of the device, and in particular, to change the display to be viewed through the one or more windows in the dial assembly.

Such a device, however, is believed to be desirable in that it further permits the customization and changeability of the display as well as allows for the reduced costs associated with the manufacturing of a variety of wearable electronic device styles using a generically constructed digital display, such as a liquid crystal display, assembly.

SUMMARY AND OBJECTIVES OF THE INVENTION

It is thus an objective of the present invention to overcome the perceived deficiencies in the prior art.

It is another objective and advantage of the present invention to provide a wearable electronic device that utilizes a digital display, such as liquid crystal display assemblies, but which can accommodate differing dial assemblies thereby providing differing display configurations.

It is yet another object of the present invention to provide an improved wearable electronic device in which the display configuration can be modified, changed and/or enhanced by the mere substitution/changing of the dial assembly.

In particular, it is an object of the present invention to provide an improved wearable electronic device comprising a digital display, such as a liquid crystal display assembly, that provides information (e.g. date, day, month, time) in which the display configuration can be modified, changed and/or enhanced by the mere substitution/changing of the dial assembly, and in particular, by the changing of the dial assemblies which themselves allow for the viewability of differing display sections of the digital display.

Still another object of the present invention is to provide a wearable electronic device, and a method of making it, that can be made at reduced manufacturing costs, inventory costs and scheduling time, as well as providing an improved and increased efficiency in manufacturing flexibility.

Still other objects and advantages of the invention will in part be obvious and will in part be apparent from the specification.

The invention accordingly comprises the features of construction, combination of elements and arrangement of parts and sequence of steps which will be exemplified in the construction, illustration and description hereinafter set forth, and the scope of the invention will be indicated in the claims.

To carry out the advantages and objectives set forth above and below, the present invention, generally speaking in a first embodiment, is directed to a display assembly for a wearable electronic device, wherein the display assembly is disposed within a housing of the wearable electronic device, and wherein the housing is constructed to receive at least a first and second dial assembly each of which is adapted to provide a different display configuration, wherein the display assembly comprises a digital display assembly comprising a first display section, for displaying first information in a selected format and at least a second display section, for displaying the first information in the selected format; driving means for providing driving signals to the respective first and second display sections; and a controller, operatively coupled to the driving means, for signaling the driving means to provide the driving signals; wherein the display configuration of the wearable electronic device is changeable based on the dial assembly operatively coupled within the housing, wherein the first dial assembly provides for the viewability of at least the first display section and the second dial assembly provides for the viewability of at least the second display section. In this way, varying displays can be provided even when the first display section displays the first information in the selected format simultaneously with the second display section displaying the first information in the selected format.

In one specific but non-limiting embodiment, the digital display is a cholesteric liquid crystal display assembly.

In another embodiment, a preferred embodiment of the invention is directed to a method of customizing the display of a wearable electronic device, wherein the wearable electronic device comprises a display assembly disposed within a housing of the wearable electronic device, and wherein the housing is constructed to receive at least a first and second dial assembly each of which is adapted to provide a different display configuration, and wherein the display assembly comprises a digital display assembly comprising a first display section and at least a second display section, driving means for providing driving signals to the respective first and second display sections, and a controller, operatively coupled to the driving means, for signaling the driving means to provide the driving signals; wherein the method comprises the steps of selecting between a first display configuration and a second display configuration that is different from the first configuration; and if the first display configuration is desired, coupling the first dial assembly, which provides viewability of at least the first display section, to the housing; and if the second display configuration is desired, coupling the second dial assembly, which provides viewability of at least the second display section, to the housing; wherein the display configuration of the wearable electronic device is changeable based on the dial assembly operatively coupled within the housing.

In the preferred embodiment, the electronic device has timekeeping functionality, and thus, in a specific embodiment, is a wristwatch.

BRIEF DESCRIPTION OF THE DRAWINGS

The above set forth and other features of the invention are made more apparent in the ensuing Description of the Preferred Embodiments when read in conjunction with the attached Drawings, wherein.

Like reference numerals used in the various figures represent like parts or elements, but not every part or element in each figure may be indicated with a reference numeral.

DETAILED DESCRIPTION OF THE PREFERRED EMBODIMENTS

Figure 1:
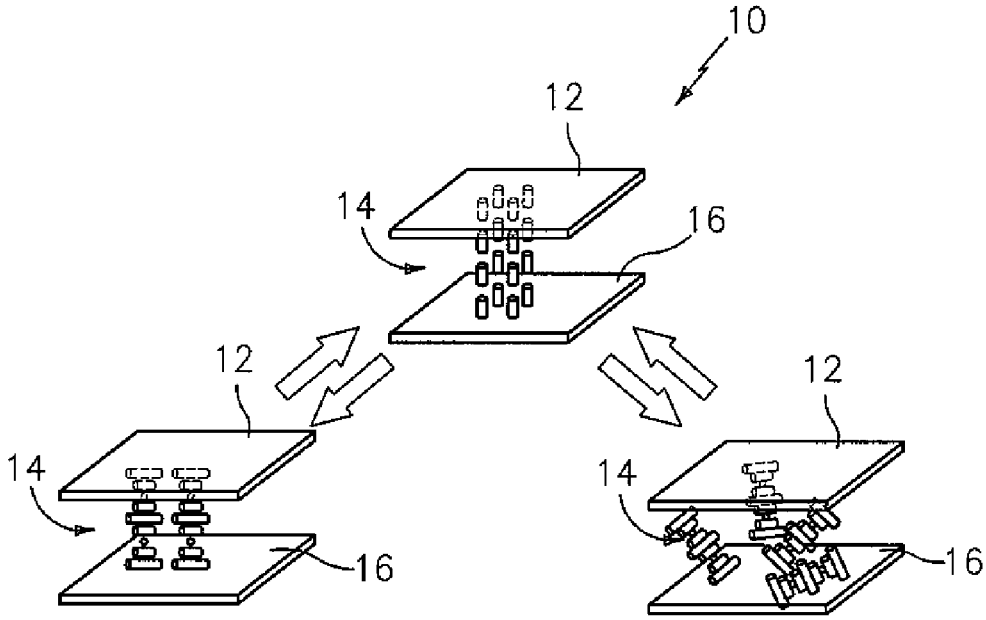
FIG. 1 shows states of a cholesteric liquid crystal display arrangement utilizable in the present invention.
Figure 2:
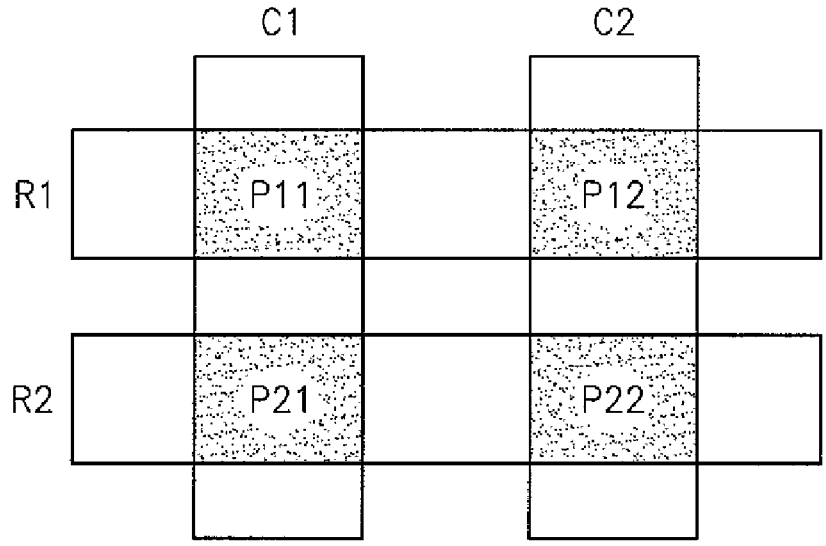
FIG. 2 shows a pixel arrangement and pixel driving of a cholesteric liquid crystal display arrangement utilizable in the present invention.

Reference is first made to FIGS. 1 and 2 for a brief description of how a liquid crystal display, and in the preferred embodiment, being a cholesteric liquid crystal display, works. Because it is believed that the construction of a cholesteric liquid crystal display is extremely well known by those skilled in the art (see, for example, all the existing patents assigned to Kent Displays, Inc. out of Kent, Ohio), the following is set forth presumably more for merely to ensure completeness and as otherwise background information.

With the preferred liquid crystal display being of the cholesteric type and the advantages afforded thereby being known to those skilled in the art, the display element, generally indicated at 10, comprises a transparent glass 12, a plurality of liquid crystal units 14 and a light-absorbing glass 16. Alternatively, as is known in the art, the liquid crystal display can be made flexible by utilizing flexible plastic materials in place of the glass components. When a voltage is applied to display element 10, liquid crystal units 14 of the reflective cholesteric liquid crystal display type will arrange according to the applied voltage (as shown in the middle diagram of FIG. 1). When there is no applied voltage, a cholesteric liquid crystal display element of the reflective type has two stable states: a planar texture and a focal conic texture.

The planar texture is a bright state, that is, the liquid crystal units arrange with a rule on the turn (as shown in the left bottom diagram of FIG. 1), and the outside light can be through the transparent glass 12, the liquid crystal units 14 and the light-absorbing glass 16 with half quantities reflect. On the other hand, the focal conic texture is a dark state, wherein the liquid crystal units 14 irregularly arrange (as shown in the right bottom diagram of FIG. 1), and the outside light disorderly enters and is completely absorbed by the light-absorbing glass 16. When there is no applied voltage, the stable state of a reflective cholesteric liquid crystal display is determined by the previous applied voltage.

FIG. 2 illustrates a plurality of pixels P11, P12, P21 and P22 in a display section of a cholesteric liquid crystal display. The pixels are controlled by a plurality of column electrodes C1, C2 and a plurality of row electrodes R1, R2. The pixels are disposed on crossing areas between the column electrodes and the row electrodes. For example, the pixel P11 is controlled by an applied signal combined from the column electrode C1 and the row electrode R1. The waveforms and timing of the first row electrodes R1, the second row electrodes R2, the first column electrode C1, the first pixel P11 and the second pixel P21 are well known to those skilled in the art.

Figure 3:
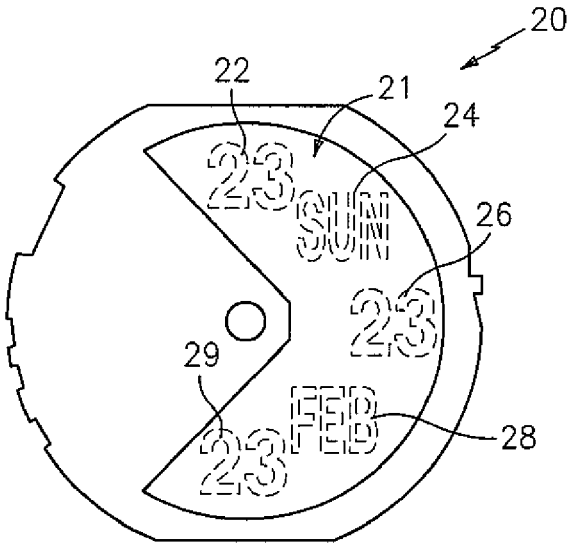
FIG. 3 is a top plan view of a display assembly constructed in accordance with the present invention.

With the foregoing in mind, reference is briefly made to FIG. 3, which illustrates a display assembly, generally indicated at 20, constructed in accordance with the present invention.

More particularly, display assembly 20 comprises a liquid crystal display assembly 21 preferably comprised of a plurality of display sections, such as those indicated generally by reference numerals 22, 24, 26, 28 and 29, made up of a plurality of display elements such as those set forth in FIG. 2, each section comprising a great deal more of such pixels, as also would be well known to those skilled in the art.

In an exemplary illustration, display sections 22, 26 and 29 are displaying the date (e.g. the "2$^{rd}$" day of the month), display section 24 is displaying the day of the week (e.g. "SUN") and display section 28 is displaying the month (e.g. "FEB"). Again, these are all by way of example and not limitation. That is, there could be more or less than five (5) display sections. Moreover, as would be understood by those skilled in the art, each display section comprises a plurality of pixels, wherein the plurality of pixels are operatively coupled to a plurality of column electrodes and a plurality of row electrodes, wherein the plurality of pixels are disposed on crossing areas between the plurality of column electrodes and the plurality of row electrodes.

To better understand the terms used herein, reference may also be made to "first" information (e.g. the date (e.g. "23")) so as to distinguish it from some other (e.g. second) information, such as the day (e.g. "SUN"). Therefore, as used herein, if one display section (e.g. section 22) is displaying "first" information and another display section (e.g. section 24) is displaying "second" information, display sections 22 and 24 are not displaying the same information, although it must be understood that "first" information need not be "date" information and second information need not be "day" information. Consistent therewith, in the illustration of FIG. 3, display section 22 is displaying the date and display section 24 is displaying the day. Also used herein may be the term "format," which may be used merely to highlight the particular way in which information can be presented. For example, FIG. 3 illustrates the date in a "two-digit" format and the day in a "three-letter" format. Such terms are used merely to clarify how information is presented, as may become clearer below.

Therefore, by way of example, it can be seen that FIG. 3 illustrates display sections 22, 26 and 29 displaying first (e.g. date) information in a selected format (e.g. in a two digit format), while display section 24 displays second (e.g. day) information in a selected format (e.g. in a three-letter format), and display section 28 displays third (e.g. month) information in a selected format (e.g. in a three-letter format). Again to be sure, there is no correlation or requirement that "first" information means date information, etc. but rather only that the terms "first," "second" and "third" etc. are used to distinguish that one information is different from another, as will be discussed in further detail below.

Figure 4:
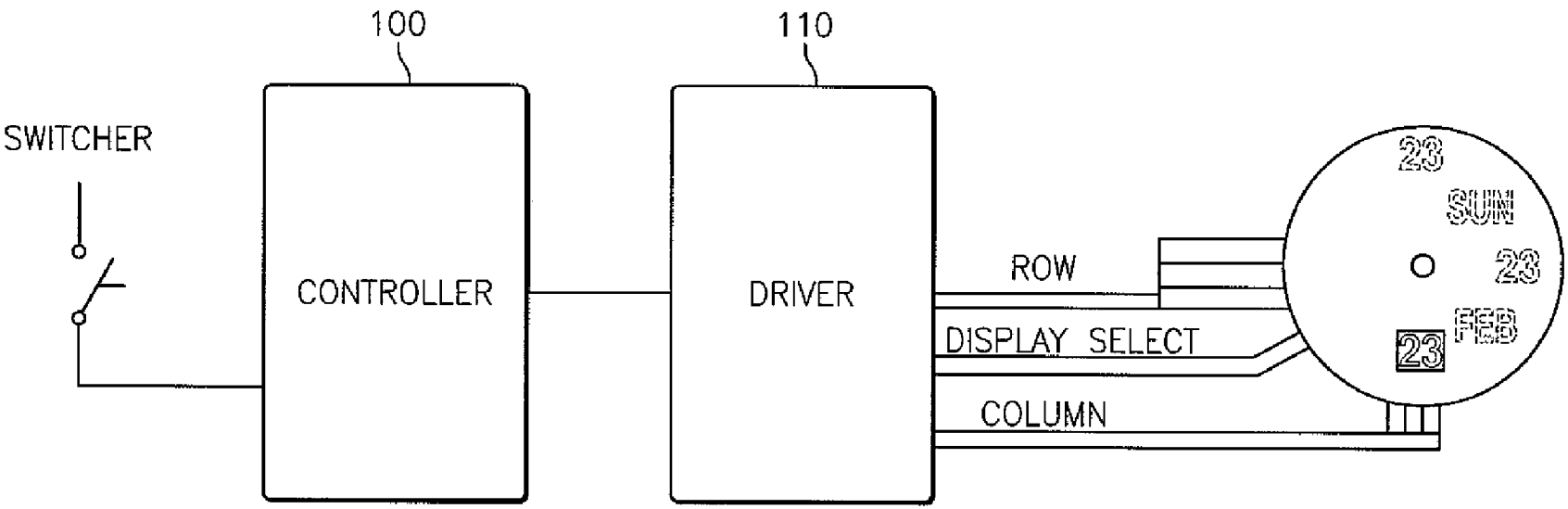
FIG. 4 illustrates a simplified circuit diagram in accordance with the present invention.

Reference is now made to FIG. 4 which shows an exemplary circuit to carry out the objectives of the present invention. In this simplified illustration, a controller 100 is coupled to a driver 110. Driver 110 is coupled to the LCD assembly, such as that illustrated by LCD assembly 120 in FIG. 6, all of which would be understood by one skilled in the art. Dial 70 may be a dial such as that described in U.S. Pat. No. 4,775,964. In accordance with the above disclosure, one or more busses of row and column lines/electrodes are provided to operate the corresponding number of displays, as disclosed herein. Thus, the number of actual lines illustrated in the figures is exemplary only, as the proper number and method of operationally coupling the LCD, whether a ChLCD or otherwise, to the driver and/or controller circuitry would be understood by one skilled in the art. In this way, the driving means can provide driving signals to the respective display sections and the controller, operatively coupled to the driving means, can provide signaling to the driving means to provide the driving signals. It should also be understood that the underlying circuitry and timekeeping functionality to provide the proper signaling and keep the proper time, date, and day information is well known to those skilled in the art. Reference numeral 140 is provided in FIG. 6 to generally reference all of the foregoing and/or needed hardware and software therefore. Motors and other features to drive analog hands are not shown for purposes of brevity, but are also well understood by those skilled in the art. Also, the spacing shown between layers and/or the relative size of the layers in FIG. 6 are merely for convenience and do not represent any specific dimensions, as it would surely be understood that sufficient room would have to be provided to incorporate hour and minute (and/or other hands), by way of example.

Figure 5A:
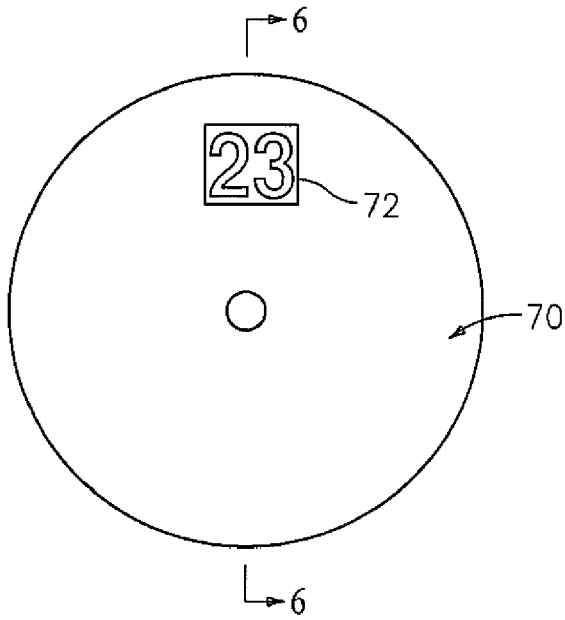
FIGS. 5A, 5B, 5C and 5D illustrate a display assembly with exemplary dial assemblies on top thereof.
Figure 5B:
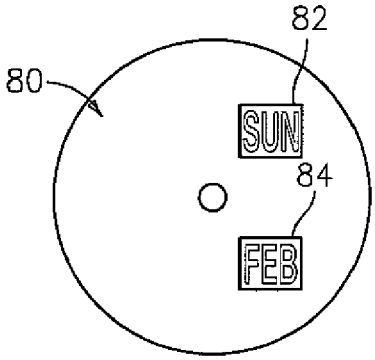
Figure 5C:
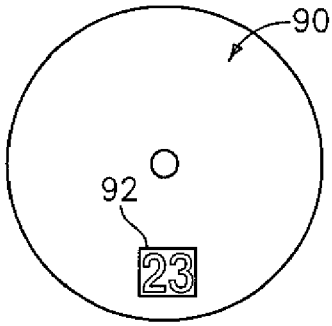
Figure 5D:
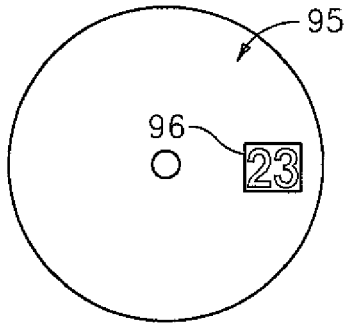
Figure 6:
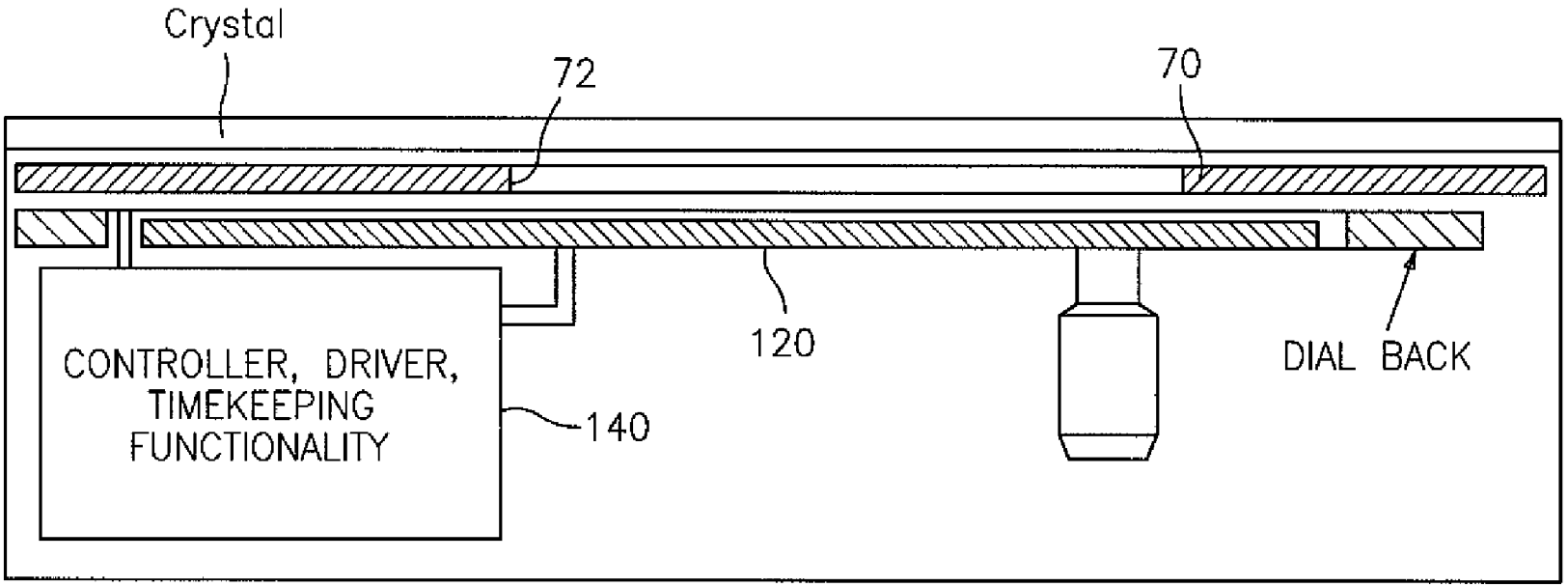
FIG. 6 is a simplified cross-sectional view of the dial assembly of FIG. 5A.

Reference is now made to FIGS. 5A, 5B, 5C and 5D which illustrate a display assembly with various dial assemblies on top thereof, all in accordance with the present invention, along with FIG. 6, which illustrates a simplified cross-sectional view of the dial assembly of FIG. 5A.

Specifically, display assembly 20 having been constructed as set forth above, is disposed within a housing/module 50 of the wearable electronic device, and wherein housing 50 is constructed to receive at least a first and second dial assembly each of which is adapted to provide a different display configuration. FIGS. 5A, 5B, 5C and 5D illustrate various dial assemblies, each of which will now be disclosed.

For example, FIG. 5A illustrates a dial assembly 70 having an opening 72 through which display section 22 is visible. Visible through opening 72 is the day information. In yet another example, FIG. 5B illustrates a dial assembly 80 having openings 82 and 84 through which display sections 24 and 28 are respectively visible. In still yet another example, FIG. 5C illustrates a dial assembly 90 having opening 92 through which display section 29 is visible. Visible through opening 92 is date information. FIG. 5D illustrates a dial assembly 95 having opening 96 through which display section 26, also date information, is visible.

It can thus be seen, that the display configuration of the wearable electronic device is changeable based on the dial assembly operatively coupled within the housing and on top of the display assembly. More particularly, it can be seen that dial assembly 70 provides for the viewability of at least a first display section (e.g. display section 22), while a second dial assembly (e.g. dial assembly 80 provides for the viewability of display sections 24 and 28), yet while a third dial assembly 90 provides for the viewability of yet a third display section (e.g. display section 29) while still a forth dial assembly (e.g. dial assembly 95) provides for the viewability of yet another display section (e.g. display section 26).

To be sure, the present invention is not directed merely to the idea of merely providing differing display configurations, but rather, to a more specific, generically configured display assembly that can accommodate such differing dial assemblies without further modification or adjustment thereto. In this way, an electronic device manufacturer can essentially design one display assembly module that is able to be used with varying dial assemblies, each of which can provide a differing display configuration as exemplified herein.

Furthermore, it should be understood while the foregoing embodiments have been primarily disclosed in connection with the use of a cholesteric liquid crystal display assembly, other digital display assemblies could be incorporated therein and are thus likewise contemplated herein and covered by the claims. For example, in place of pixels with electrodes for columns and rows, conventional segments with front and back electrodes could be used instead (or in some other complementary fashion).

To this end, along with the foregoing, the present invention has several specific features believed not to be described or suggested in the prior art.

For example, the display assembly disclosed in FIG. 5B may have (in addition to display sections 24 and 28 operational) display sections 22, 26 and/or 29 operational. That is, were one to lift and remove dial 80 from display assembly 20 one may see information (e.g. date information) displayed in display sections 22, 26 and/or 29. Similarly, were one to lift and remove dial 90 or 95 from display assembly 20 one may see information (e.g. day or month information) displayed in display sections 24 or 28, respectively.

Moreover, even if such non-visible display sections are operational, using cholesteric liquid crystal displays for example, one skilled knows that the battery drain (if any) is overwhelmingly small compared to the significant savings achieved by not having to construct various display assemblies to individually accommodate various dial assemblies so as to provide differing display configurations.

In yet an alternative embodiment, the present invention comprises a selector/switcher for selecting between/among the actuation of the display sections. Thus, in this alternative embodiment, it may be desirable not to have display sections, which may otherwise be covered by a dial assembly, operational. Therefore, for example, in the display assembly disclosed in FIG. 5B, it is possible that only display sections 24 and 28 are operational and that the remaining display sections 22, 26 and 29, and more technically speaking, the column and row electrodes associated therewith, are electrically disabled. Similarly, in the example of FIG. 5C, it would be that only display section 29 is operational and that the remaining display sections 22, 24, 26 and 28, and more technically speaking, the column and row electrodes associated therewith, are electrically disabled. Similar examples can be explained with respect to FIGS. 5A and 5D. FIG. 4 illustrates generally the inclusion of one or more "display select" lines in the event that it is desirable to select what displays are to be operational. In a specific embodiment, the display selection may be achieved by bonding options, namely by providing and/or omitting bond wires, closing or opening selected electrical connections and/or adding or omitting of selected solder joints.

The selector/switcher may comprise software-programming functionality. Alternatively, the selector/switcher may comprise an arrangement on the display assembly itself, wherein the dial assembly, when coupled in the housing, engages the arrangement of the selector/switcher (e.g. a "plug-in" like effect) to cause the selecting between/among the actuation of the display sections thereby signaling to the controller indicating which dial assembly has been coupled in the housing. Yet in another alternative embodiment, the selector/switcher is achieved by bonding options, namely by providing and/or omitting bond wires, closing or opening selected electrical connections and/or adding or omitting of selected solder joints. In yet still a further embodiment, means for changing the display configurations of the liquid crystal display are controlled by the controller and such change can even be effectuated by substitution of controllers.

Still further, the means for changing may comprise a button sequence, which can be initiated at the manufacturing stage or by the end user. For example, the display may be changeable or customizable or otherwise modifiable, all such variations and like terms intending to imply throughout this disclosure the same idea of changing which display sections are enabled or visible, by the user or after the electronic device has been constructed. Such an innovation would allow, for example, an end user to change the dial assemblies if necessary or desirable.

All of the foregoing thus provides for the changeability of the display configuration of the wearable electronic device based on the dial assembly used therewith.

It will thus be seen that the present invention is both patentably different from and a significant improvement over known devices. Specifically, the present invention provides a unique way to provide a single display assembly that can accommodate differing dial assemblies to provide differing display configurations. The innovation of a generically constructed platform requiring merely the changing of dial assemblies in the manner claimed to provide the versatility and flexibility of display is believed to be both novel and non-obvious in view of the known art.

That is, it will thus be seen that the present invention is directed to a display assembly for a wearable electronic device, wherein the display assembly is disposed within a housing of the wearable electronic device, and wherein the housing is constructed to receive at least a first and second dial assembly each of which is adapted to provide a different display configuration, wherein the display assembly comprises a digital display assembly comprising a first display section, for displaying first information in a selected format; and at least a second display section, for displaying the first information in the selected format; and driving means for providing driving signals to the respective first and second display sections; and a controller, operatively coupled to the driving means, for signaling the driving means to provide the driving signals; wherein the display configuration of the wearable electronic device is changeable based on the dial assembly operatively coupled within the housing, wherein the first dial assembly provides for the viewability of at least the first display section and the second dial assembly provides for the viewability of at least the second display section, even though the first display section displays the first information in the selected format simultaneously with the second display section displaying the first information in the selected format.

In a specific embodiment, the first display section comprises a plurality of first pixels, wherein the plurality of first pixels are operatively coupled to a plurality of first column electrodes and a plurality of first row electrodes, wherein the plurality of first pixels are disposed on crossing areas between the plurality of first column electrodes and the plurality of first row electrodes; the second display section comprises a plurality of second pixels, wherein the plurality of second pixels are operatively coupled to a plurality of second column electrodes and a plurality of second row electrodes, wherein the plurality of second pixels are disposed on crossing areas between the plurality of second column electrodes and the plurality of second row electrodes; and the driving means provides driving signals to the respective column electrodes and row electrodes.

In another specific embodiment, the first display section comprises a plurality of first segments, wherein the plurality of first segments are operatively coupled to a plurality of first front electrodes and a plurality of first back electrodes; the second display section comprises a plurality of second segments, wherein the plurality of second segments are operatively coupled to a plurality of second front electrodes and a plurality of second back electrodes; and the driving means provides driving signals to the respective front and back electrodes.

If desired, the display assembly may comprise selecting/switching means, operatively coupled to the driving means or to the controller, for selecting between/among the actuation of the plurality of first pixels and second pixels.

In one example, the first dial assembly comprises a window for viewability of the at least first display section; and the second dial assembly comprises a window for viewability of the at least second display section but does not include a window for viewability of the first display section.

In the inventive methodology, a preferred embodiment comprises the customizing of the display, and comprises the steps of selecting between a first display configuration and a second display configuration that is different from the first configuration; and if the first display configuration is desired, coupling the first dial assembly, which provides viewability of at least the first display section, to the housing; and if the second display configuration is desired, coupling the second dial assembly, which provides viewability of at least the second display section, to the housing; wherein the display configuration of the wearable electronic device is changeable based on the dial assembly operatively coupled within the housing.

While the invention has been particularly shown and described with respect to preferred embodiments thereof, it will be understood by those skilled in the art that changes in form and details may be made therein without departing from the scope and spirit of the invention.

Lastly, the preferred embodiment of the present invention is incorporated into a timepiece and a wristwatch in particular. The electronic device thus being a timepiece such as a wristwatch will thus comprise other features and parts, omitted herein for purposes of brevity.

Alternatively, the electronic device may be in the form of and/or have functionality related to altitude, temperature or compass measurements, barometric pressure, a heart rate display, blood pressure (and/or combinations thereof), the display of tide information, sunset information, moon phases, medical information such as when medicine should be taken and how many pills at each time interval or any other information that could be displayed on a liquid crystal display, such as a counter/timer or any one of additional parameters such as water pressure, water depth and oxygen left in a diver's tank (i.e. a diver's watch); object finder (i.e. to find one's car or way back to a starting location); blood/sugar levels (a glucometer); speed and distance (a runner's watch); displaying how much money is in a debit account; and any combination of the foregoing, all of which may be in addition to or in the absence of conventional timekeeping functionality. Providing the specific information in one or more of the display windows and then providing the appropriate dial assembly facilitates the design of many styles of product with minimal incremental costs to manufacture.

What is claimed is:

1. A display assembly for a wearable electronic device, wherein the display assembly is disposed within a housing of the wearable electronic device, and wherein the housing is constructed to receive at least a first and second dial assembly each of which is adapted to provide a different display configuration, wherein the display assembly comprises:

a digital display assembly comprising:

a first display section, for displaying first information in a selected format; and at least a second display section, for displaying the first information in the selected format; and driving means for providing driving signals to the respective first and second display sections so that the first display section displays the first information in the selected format and the second display section displays the first information in the selected format; and a controller, operatively coupled to the driving means, for signaling the driving means to provide the driving signals;

wherein the display configuration of the wearable electronic device is changeable based on the dial assembly operatively coupled within the housing, wherein the first dial assembly provides for the viewability of at least the first display section and the second dial assembly provides for the viewability of at least the second display section.

2. The display assembly for a wearable electronic device as claimed in claim 1, wherein:

the first display section comprises a plurality of first pixels, wherein the plurality of first pixels are operatively coupled to a plurality of first column electrodes and a plurality of first row electrodes, wherein the plurality of first pixels are disposed on crossing areas between the plurality of first column electrodes and the plurality of first row electrodes;

the second display section comprises a plurality of second pixels, wherein the plurality of second pixels are operatively coupled to a plurality of second column electrodes and a plurality of second row electrodes, wherein the plurality of second pixels are disposed on crossing areas between the plurality of second column electrodes and the plurality of second row electrodes; and the driving means provides driving signals to the respective column electrodes and row electrodes so that the first display section displays the first information in the selected format simultaneously with the second display section displaying the first information in the selected format.

3. The display assembly as claimed in claim 2, comprising selecting/switching means, operatively coupled to the driving means, for selecting between/among the actuation of the plurality of first pixels and second pixels.

4. The display assembly as claimed in claims 3, wherein the selecting/switching means comprises software-programming functionality.

5. The display assembly as claimed in claim 3, wherein the selecting/switching means, operatively coupled to the controller, comprises an arrangement on the display assembly itself; and wherein the dial assembly, when coupled in the housing, engages the arrangement of the selecting/switching means to cause the selecting between/among the actuation of the plurality of the first pixels and second pixels;

thereby signaling to the controller indicating which dial assembly has been coupled in the housing.

6. The display assembly as claimed in claim 2, wherein the selecting/switching means is achieved by bonding options, namely by providing and/or omitting bond wires, closing or opening selected electrical connections and/or adding or omitting of selected solder joints.

7. The display assembly for a wearable electronic device as claimed in claim 1, wherein:

the first display section comprises a plurality of first segments, wherein the plurality of first segments are operatively coupled to a plurality of first front electrodes and a plurality of first back electrodes;

the second display section comprises a plurality of second segments, wherein the plurality of second segments are operatively coupled to a plurality of second front electrodes and a plurality of second back electrodes; and the driving means provides driving signals to the respective front and back electrodes so that the first display section displays the first information in the selected format simultaneously with the second display section displaying the first information in the selected format.

8. The display assembly as claimed in claim 7, comprising selecting/switching means, operatively coupled to the driving means, for selecting between/among the actuation of the plurality of first pixels and second pixels.

9. The display assembly as claimed in claim 1, comprising first and second dial assemblies, wherein:

the first dial assembly comprises a window for viewability of the at least first display section; and the second dial assembly comprises a window for viewability of the at least second display section but does not include a window for viewability of the first display section.

10. The display assembly as claimed in claim 1, wherein the wearable electronic device is a wristwatch.

11. A method of customizing the display of a wearable electronic device, wherein the wearable electronic device comprises a display assembly disposed within a housing of the wearable electronic device, and wherein the housing is constructed to receive at least a first and second dial assembly each of which is adapted to provide a different display configuration, and wherein the display assembly comprises a digital display assembly comprising a first display section and at least a second display section, driving means for providing driving signals to the respective first and second display sections, and a controller, operatively coupled to the driving means, for signaling the driving means to provide the driving signals; wherein the method comprises the steps of:

selecting between a first display configuration and a second display configuration that is different from the first configuration; and if the first display configuration is desired, coupling the first dial assembly, which provides viewability of at least the first display section, to the housing; and if the second display configuration is desired, coupling the second dial assembly, which provides viewability of at least the second display section, to the housing;

wherein the display configuration of the wearable electronic device is changeable based on the dial assembly operatively coupled within the housing and wherein the first display section displays the first information in the selected format simultaneously with the second display section displaying the first information in the selected format.

12. The method of customizing the display of a wearable electronic device as claimed in claim 11, wherein the first display section comprises a plurality of first pixels operatively coupled to a plurality of first column electrodes and a plurality of first row electrodes, wherein the plurality of first pixels are disposed on crossing areas between the plurality of first column electrodes and the plurality of first row electrodes; the second display section comprises a plurality of second pixels operatively coupled to a plurality of second column electrodes and a plurality of second row electrodes, wherein the plurality of second pixels are disposed on crossing areas between the plurality of second column electrodes and the plurality of second row electrodes; and the driving means provides driving signals to the respective column electrodes and row electrodes.

13. The method of customizing the display of a wearable electronic device as claimed in claim 11, wherein the first display section comprises a plurality of first segments, wherein the plurality of first segments are operatively coupled to a plurality of first front electrodes and a plurality of first back electrodes; the second display section comprises a plurality of second segments, wherein the plurality of second segments are operatively coupled to a plurality of second front electrodes and a plurality of second back electrodes; and the driving means provides driving signals to the respective front and back electrodes.

14. The method of customizing the display of a wearable electronic device as claimed in claim 11, comprising the steps of:

providing the first dial assembly with a window for viewability of the at least first display section; and providing the second dial assembly with a window for viewability of the at least second display section but does not include a window for viewability of the first display section.

* * * * *